US005595555A

United States Patent [19]

Chen

[11] Patent Number: 5,595,555

[45] Date of Patent: Jan. 21, 1997

[54] WALKING EXERCISE APPARATUS

[76] Inventor: David Chen, P.O. Box 63-150, Taichung, Taiwan

[21] Appl. No.: 647,556

[22] Filed: May 14, 1996

[51] Int. Cl.[6] ..... A63B 22/00

[52] U.S. Cl. ..... 482/51; 434/255

[58] Field of Search ..... 482/51, 52, 53, 482/54, 70, 111, 112, 125; 434/247, 255; 601/33, 35

[56] References Cited

U.S. PATENT DOCUMENTS

| | | | |
|---|---|---|---|
| 4,940,233 | 7/1990 | Bull | 482/51 |
| 5,000,443 | 3/1991 | Dalebout et al. | 482/51 |
| 5,290,211 | 3/1994 | Stearns | 482/53 |
| 5,419,747 | 5/1995 | Piaget et al. | 482/51 |
| 5,496,235 | 3/1996 | Stevens | 482/52 |
| 5,536,224 | 7/1996 | Hsieh | 482/51 |

*Primary Examiner*—Stephen R. Crow

[57] ABSTRACT

An improved walking exercise apparatus includes a main frame, a positive drive means, a reverse drive means and two suspension bars. The main frame consists of two side upright supports and a base. The positive drive means consists of two drive chain wheels disposed at both ends of one side upright support, chains being partially engaging the circumferential rims of the drive chain wheels respectively and the chains being linked by rigid connecting elements. The reverse drive means consists of two drive chain wheels disposed at both ends of the other side upright support, chains being partially engaging the circumferential rims of the drive chain wheels respectively and the chains being linked by rigid connecting elements in a cross configuration. The suspension bars are pivotally disposed at the inner sides of the side upright supports near their upper ends and are coaxially secured with the upper drive chain wheels of the side upright supports respectively to allow pivotal swinging movement. The suspension bars respectively have a foot rest at a bottom end thereof.

3 Claims, 4 Drawing Sheets

WALKING EXERCISE APPARATUS

BACKGROUND OF THE INVENTION (a) Field of the Invention

The present invention relates generally to an exercise apparatus, and more particularly to an improved walking exercise apparatus.

(b) Description of the Prior Art

A prior walking exercise apparatus is disclosed in U.S. Pat. No. 4,850,585. The prior exercise apparatus, as shown in FIG. 1, essentially comprises two side upright supports 1 and an I-shaped base 2. The upper ends of the side upright supports 1 are respectively, pivotally provided with a suspension bar 3. By utilizing two foot rests 4 at the bottom ends of the suspension bars 3, the user may stand on the suspending foot rests 4 and perform walking exercises. The pivotal ends of the side upright supports 1 are respectively, fixedly provided with a drive chain wheel 5. A section of a drive chain 6 is disposed on each drive chain wheel 5. Both ends of the drive chain 6 are secured to steel cables 7, 8 respectively. The steel cables 7, 8 are guided by two pivotal rollers 9 provided at the bottom ends of the side upright supports 1 to cause the drive chain wheels 5 to rotatably displace in opposite directions, so that the user may perform forward and rearward swinging movement to simulate walking by exerting suitably forces on the foot rests of the suspension bars 3. As the drive chain wheel 5 has to utilize the steel cables 7, 8 in order to change rotational direction. As a result, the space left at the bottom side of the side upright supports will be occupied and the base 2 will have to be very space-occupying. Besides, the steel cables 7, 8 may deform in shape when in use, and power transmission is not effective.

SUMMARY OF THE INVENTION

Accordingly, a primary object of the present invention is to provide an improved walking exercise apparatus, which is simple and compact in structure but effective.

In order to achieve the above object, an improved walking exercise apparatus, comprises a main frame consisting of a left upright upright support, a right upright support and a base with its ends connected to the respective bottom ends of the left and right upright supports, the base having a transversely disposed rotary shaft provided thereon; a positive drive means consisting of an upper drive chain wheel and a lower drive chain wheel respectively disposed at the ends of the right upright support, the lower drive chain wheel being coaxially secured with one end of the rotary shaft, the upper drive chain wheel and the lower drive chain wheel each having a section of a drive chain engaging a circumferential rim thereof, the drive chain on the upper drive chain wheel having both ends connected to the ends of the drive chain on the lower drive chain wheel by means of two lath-like rigid connecting elements, one of the connecting elements being cut into two parts at a suitable position, the two parts having fixedly provided therein respective screw rods which are joined and positioned by means of a hollow sleeve fitted thereon, the sleeve having both ends pivotally provided with respective adjusting screws which screwably locked with the screw rods to allow axial pulling or releasing of the positive drive means; a reverse drive means consisting of an upper drive wheel and a lower drive wheel respectively disposed at the ends of the left upright support, the lower drive wheel thereof being coaxially secured with the other end of the rotary shaft, the upper drive chain wheel and the lower drive chain wheel each having a section of a drive chain engaging a circumferential rim thereof, the drive chain on the upper drive chain wheel having both ends connected to the ends of the drive chain on the lower drive chain wheel by means of two lath-like rigid connecting elements which are arranged in a slanting position and a cross relationship, one of the connecting elements being cut into two parts at a middle section thereof, the parts being joined by two connecting strips of a pre-determined length such that a space is defined between the connecting strips for passage of the other of the connecting elements; and two suspension bars respectively, pivotally disposed at the inner sides of the left and right upright supports near their upper ends, the suspension bars being coaxially secured with the upper drive chain wheels of the left and right upright supports respectively to allow pivotal swinging movement, the suspension bars respectively having a foot rest at a bottom end thereof.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
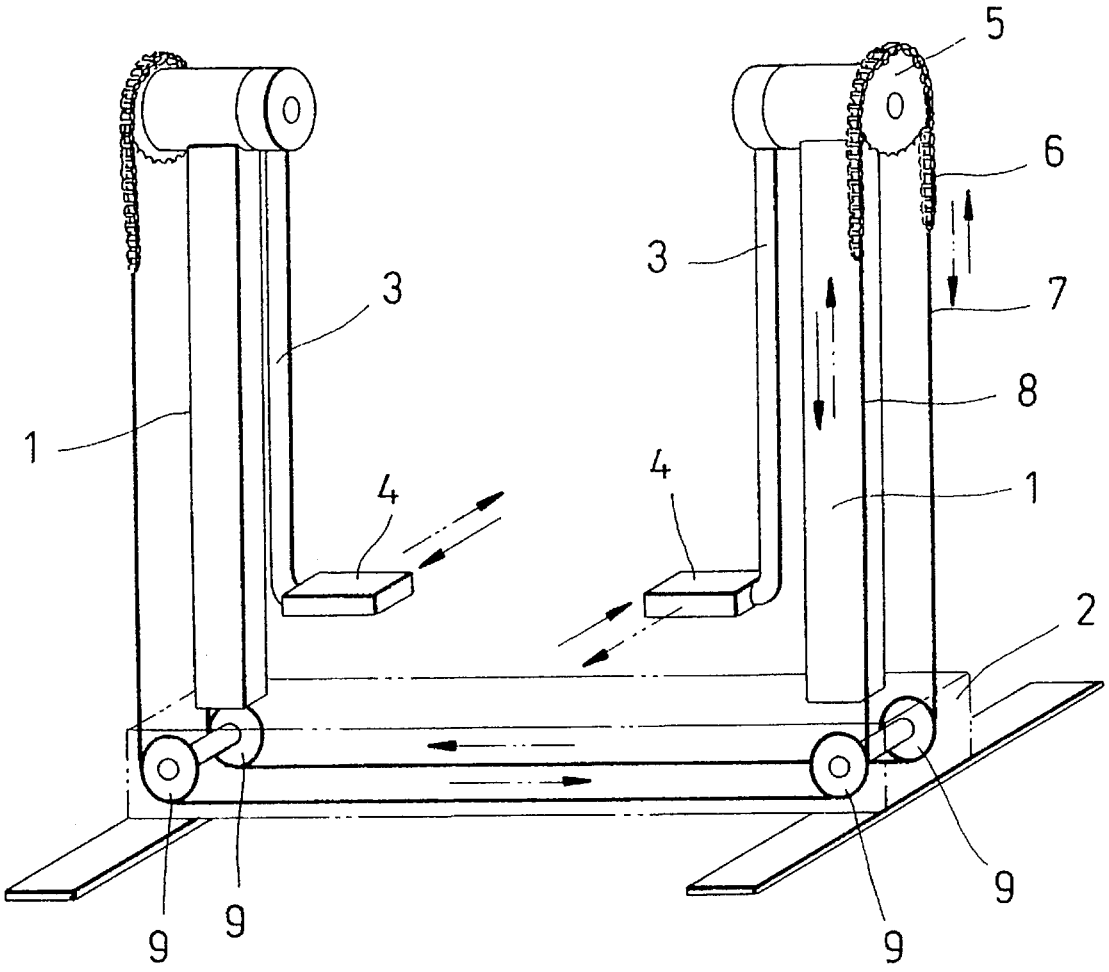
FIG. 1 PRIOR ART
FIG. 1 is a schematic view of a prior walking exercise apparatus.
Figure 2:
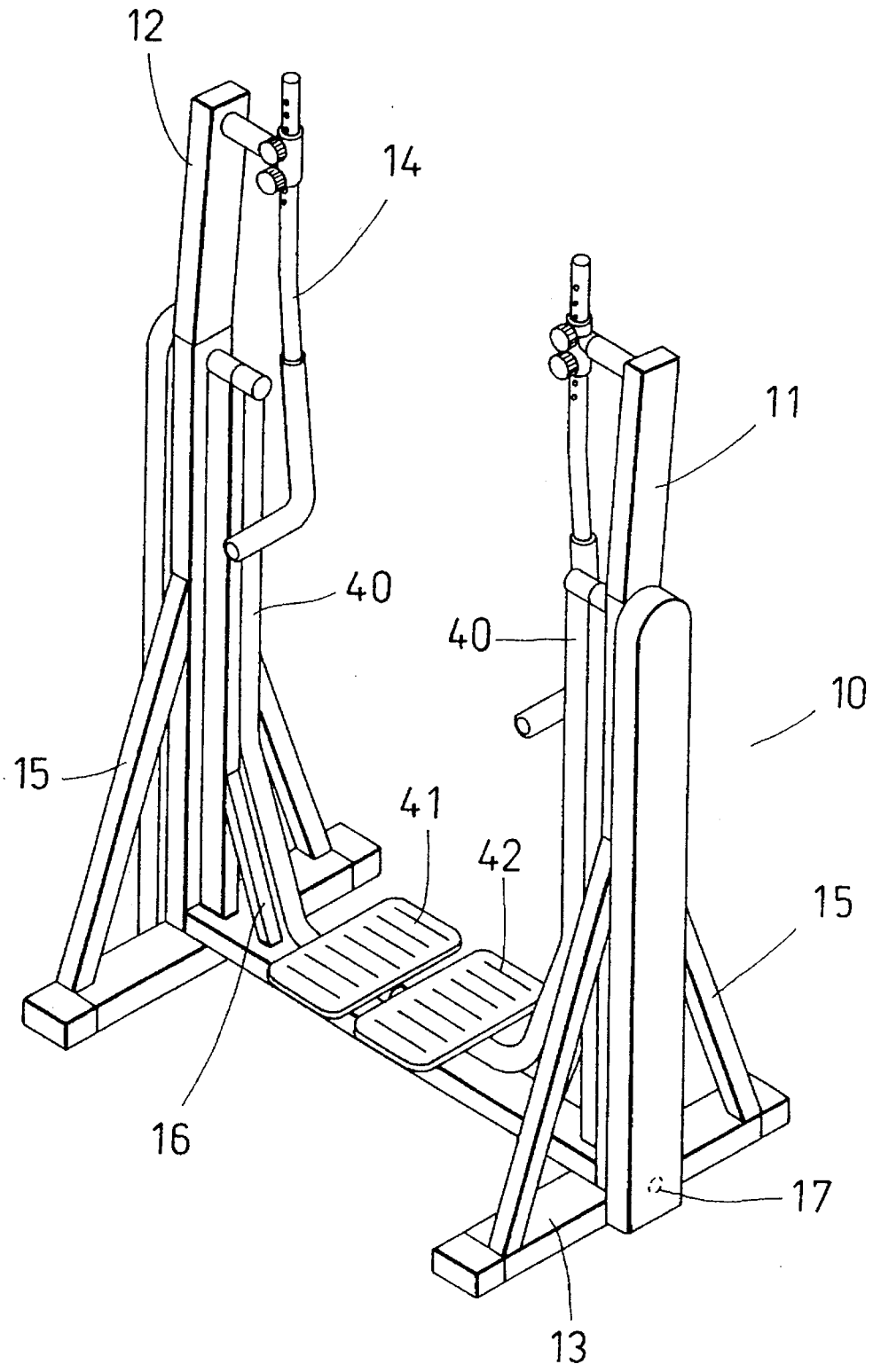
FIG. 2 is an elevational view of a preferred embodiment of the improved walking exercise apparatus of the invention.
Figure 3:
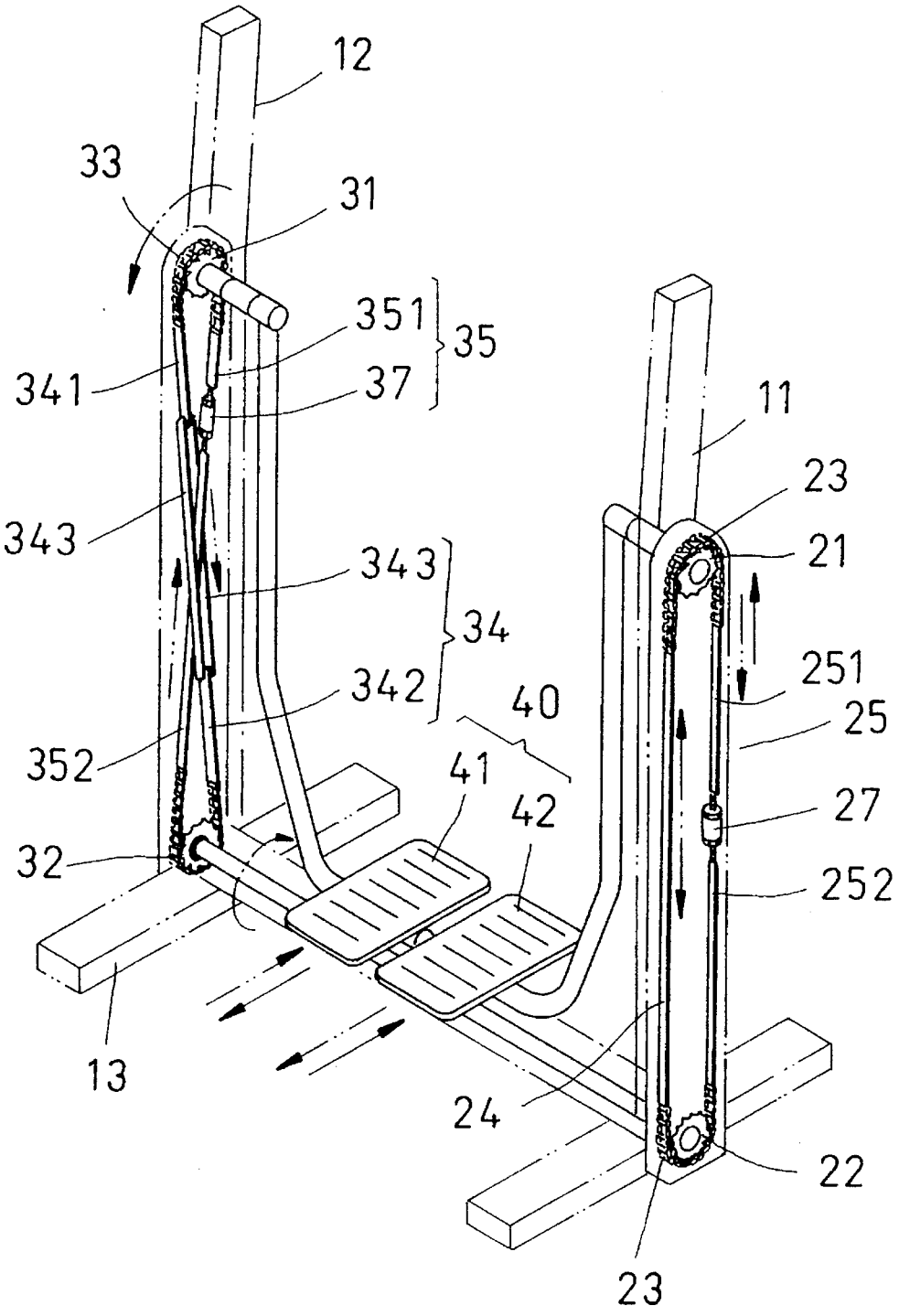
FIG. 3 is a perspective, elevational view of the preferred embodiment of the improved walking exercise apparatus of the invention.

With reference to FIGS. 2 and 3, the improved walking exercise apparatus according to the present invention essentially comprises a main frame 10, a positive drive means 20, a reverse drive means 30 and two suspension bars 40.

The main frame 10 consists of a right upright support 11, a left upright support 12 and an I-shaped base 13 consisting of two shorter bars connected to the ends of a longer bar, the upright supports 11, 12 being fixedly secured to the ends of the base 13 respectively. The left and right upright supports 11, 12 respectively have a handle bar 14 provided at an inner side thereof such that their handle bars 14 face each other across the I-shaped base 13. The handle bars 14 are arranged to allow the user's gripping while performing pivotal swinging. In order to securely support the left and right upright supports 11, 12 and to ensure that they are perpendicular to the I-shaped base 13, two relatively long struts 15 are slantingly provided at either end of each shorter bar of the I-shaped base 13 to prop up the upright support 11 (12) from opposite sides and a relatively short strut 16 is provided near either end of the longer bar of the I-shaped base 13 for supporting an inner side of the upright support 11 (12). Besides, a rotary shaft 17 is axially, pivotally provided on the I-shaped base 13.

Figure 4:
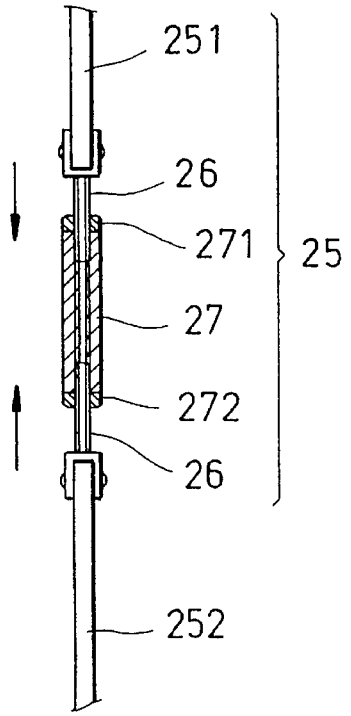
FIG. 4 is a schematic view of a positive drive means of the present invention.

The positive drive means 20, as shown in FIG. 3, consists of two drive chain wheels 21, 22 respectively disposed at top and bottom ends of the right upright support 11, the drive chain wheel 22 being secured with one end of the rotary shaft 17 pivotally provided at the main frame 10 to synchronously rotate therewith. The circumferential rim of each of the drive chain wheels 21, 22 has a section of a drive chain 23 insertably fitted thereon, each drive chain 23 has its ends respectively connected to the ends of the other drive chain 23 via two lath-like rigid connecting elements 24, 25 in a parallel relationship. The connecting element 25 is cut into two parts 251, 252 at a suitable position. Referring to FIG. 4, the cut ends of the two parts 251, 252 are each connected to one end of a screw rod 26, and a hollow sleeve 27 is then fitted onto both screw rods 26 connecting the two parts 251, 252 for positioning purposes. Two openings at the axial ends of the sleeve 27 are pivotally provided with a positive adjusting nut 271 and a reverse adjusting nut 272 respectively. By means of adjusting the adjusting nuts 271, 272, the screw rods 26 screwably locked in both ends of the sleeve 27 are caused to axially displace with respect to each other so that the connecting element 25 may be axially pulled tightly or released.

Figure 5:
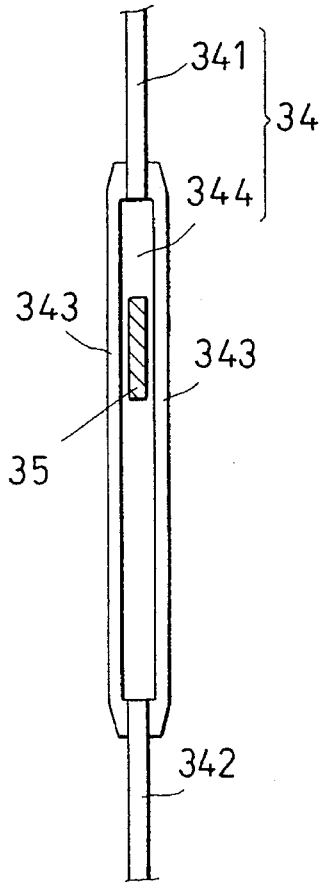
FIG. 5 is a schematic view of a reverse drive means of the present invention.
Figure 6:
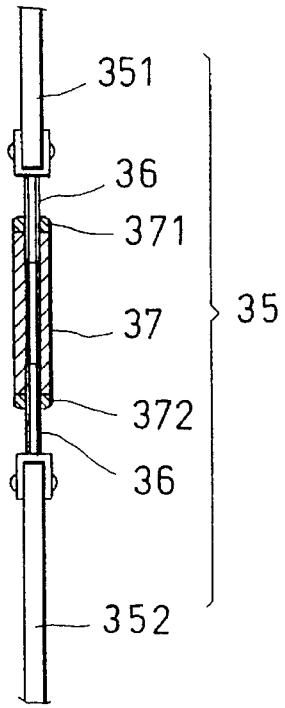
FIG. 6 is a schematic view of a rigid connecting element of the reverse drive means of the present invention.

The reverse drive means 30 is shown in FIG. 3. It consists of two drive chain wheels 31, 32 respectively located at top and bottom ends of the left upright support 12. The drive chain 32 is fixedly connected with one end of the rotary shaft 17 of the base 13 to synchronously rotate therewith. The circumferential rims of the drive chain wheels 31, 32 respectively have a section of a chain 33 insertably fitted thereon. The ends of one of the chains 33 are respectively connected to the ends of the other of the chains 33 by two rigid connecting elements 34, 35 in a cross configuration as shown in FIG. 3. Each connecting element 34 is substantially lath-like and is cut into two parts 341, 342 at the middle. The two parts 341, 342 are linked and secured in place by means of two connecting strips 343 of a predetermined length arranged in a parallel relationship as shown in FIG. 5, such that a clearance 344 is defined therebetween to allow passage of the connecting element 35. Such an arrangement enables the two connecting elements 34, 35 to cross each other without interfering with the reverse drive of the two drive chain wheels 31, 32. With further reference to FIG. 6, the connecting element 35 is also cut into two parts 351, 352 at a suitable position, and the cut ends of the two parts 351, 352 are each connected to one end of a screw rod 36. A sleeve 37 is fitted onto the two screw rods 36 for positioning purposes. The axial ends of the sleeve 37 are pivotally provided with a positive adjusting nut 371 and a reverse adjusting nut 372 respectively. By means of adjusting the adjusting nuts 371, 372, the screw rods 36 screwably locked in both ends of the sleeve 37 may be caused to axially displace with respect to each other so that the connecting element 35 may be axially pulled tightly or released.

The two suspension bars 40 bend inwardly with respect to each other. The upper ends of the suspension bars 40 are coaxially secured with the drive chain wheels 21, 31 pivotally provided at the right and left upright supports 11, 12 respectively. The bottom ends of the suspension bars 40 have secured thereon foot rests 41, 42. The user may stand on the foot rests 41, 42 to perform pivotal swinging motion.

Operation of the improved walking exercise apparatus according to the present invention is illustrated in FIGS. 2 and 3. In use, the user may grip the handle bars 14 pivotally connected to the upright supports 11, 12 on the main frame 10 and stand on the foot rests 41, 42 of the suspension bars 40 to simulate walking. While holding the handle bars 14 to oscillate back and forth naturally, the user may forcefully press the foot rests 41, 42 so that one suspension bar 40 pivotally swing to the front while the other suspension bar 40 pivotally swing to the rear, simultaneously causing the drive chain wheels 21, 31 coaxially rotating therewith and located at both sides of the main frame 10 to respectively displace through a predetermined angle in positive and reverse directions. Therefore, as a result of the arrangement of the chains 23 at both ends of the right upright support 11 and the extended or contracted state of the two connecting element 24, 25, the drive chain wheel 21 may synchronously drive the drive chain wheel 22 at the bottom end. The power is then transmitted by the horizontally disposed rotary shaft 17 to the drive chain wheel 32 at the other end of the rotary shaft 17. The rotational direction of the drive chain wheel 32 is the same as that of the drive chain wheels 21, 22 on the right upright support 11, as shown in FIG. 3. However, as the drive chain 33 fitted on the drive chain wheel 32 is linked with the chain 33 on the drive chain wheel 31 at the opposite end by means of the connecting elements 34, 35 arranged in a cross configuration, as shown in FIGS. 3 and 5, the positive rotation of the drive chain wheel 32 will be translated into reverse rotation by the drive chain wheel 31. As mentioned above, the arrangement of the space 344 at the middle section of the connecting element 34 allows the connecting element 35 to obliquely pass through the space 344. Hence, the interaction of the connecting elements 34, 35 will not interfere with each other. Moreover, by means of the adjusting nuts 371, 372 at both ends of the sleeve 37 shown in FIG. 6, the drive chain wheel 31 may perform reverse rotation with respect to the right upright support 11. Therefore, the suspension bars 40 fixedly disposed on the drive chain wheels 21, 31 may be controlled to perform repetitive, reciprocating swinging movement.

It is worth mentioning herein that, in the present invention, the drive chain wheels 21, 22 and 31, 32 of the positive and reverse drive means 20, 30 not only have fitted thereon drive chains 23, 33 respectively but also are linked by lath-like connecting elements 24, 25 and 34, 35 of excellent rigidity. Besides, the arrangement of the adjusting screws 271, 272 and 371, 372 at both ends of the respective sleeves 27 and 37 achieve minimal power loss. The special arrangements of the connecting elements 34 and 35 in a cross relationship while maintaining no interference therebetween enables the present invention to be simpler and more compact in construction and more effective in exercising effects.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved walking exercise apparatus, .comprising: a main frame consisting of a left upright upright support, a right upright support and a base with its ends connected to the respective bottom ends of said left and right upright supports, said base having a transversely disposed rotary shaft provided thereon;

a positive drive means consisting of an upper drive chain wheel and a lower drive chain wheel respectively disposed at the ends of said right upright support, said lower drive chain wheel being coaxially secured with one end of said rotary shaft, said upper drive chain wheel and said lower drive chain wheel each having a section of a drive chain engaging a circumferential rim thereof, said drive chain on said upper drive chain wheel having both ends connected to the ends of said drive chain on said lower drive chain wheel by means of two lath-like rigid connecting elements, one of said connecting elements being cut into two parts at a suitable position, said two parts having fixedly provided therein respective screw rods which are joined and positioned by means of a hollow sleeve fitted thereon, said sleeve having both ends pivotally provided with respective adjusting screws which screwably lock with said screw rods to allow axial pulling or releasing of said positive drive means;

a reverse drive means consisting of an upper drive wheel and a lower drive wheel respectively disposed at the ends of said left upright support, said lower drive wheel thereof being coaxially secured with the other end of said rotary shaft, said upper drive chain wheel and said lower drive chain wheel each having a section of a drive chain engaging a circumferential rim thereof, said drive chain on said upper drive chain wheel having both ends connected to the ends of said drive chain on said lower drive chain wheel by means of two lath-like rigid connecting elements which are arranged in a slanting position and a cross relationship, one of said connecting elements being cut into two parts at a middle section thereof, said parts being joined by two connecting strips of a pre-determined length such that a space is defined between said connecting strips for passage of the other of said connecting elements; and two suspension bars respectively, pivotally disposed at the inner sides of said left and right upright supports near their upper ends, said suspension bars being coaxially secured with said upper drive chain wheels of said left and right upright supports respectively to allow forward and rearward pivotal swinging movement, said suspension bars respectively having a foot rest at a bottom end thereof.

2. An improved walking exercise apparatus as claimed in claim 1, wherein one of said connecting elements of said reverse drive means is cut into two parts at a suitable position, said parts being connected to two screw rods respectively, said screw rods being joined and positioned by a hollow sleeve which has both ends pivotally provided with an adjusting nut for engagement with said screw rods.

3. An improved walking exercise apparatus as claimed in claim 1, wherein said left and right upright supports are respectively, pivotally connected to said handle bars capable of pivotal swinging and gripping by a user.

* * * * *